United States Patent [19]

Hoard

[11] 3,945,086

[45] Mar. 23, 1976

[54] CLOSURE DEVICE

[76] Inventor: Bert V. Hoard, Rte. 10, Box 34, Shelton, Wash. 98584

[22] Filed: Feb. 15, 1974

[21] Appl. No.: 442,889

[52] U.S. Cl. ..... 24/30.5 T

[51] Int. Cl.[2] ..... B65D 77/10

[58] Field of Search... 24/259 HC, 261 HC, 261 PT, 24/261 G, 255 H, 255 BC, 30.5 T, 5, 137 R, 71.3, 269, 30.5 S, 30.5 P

[56] References Cited

UNITED STATES PATENTS

| | | | |
|---|---|---|---|
| 2,604,103 | 7/1952 | Robb | 24/259 HC X |
| 2,787,818 | 4/1957 | Kaber | 24/5 |
| 2,981,990 | 5/1961 | Balderree | 24/30.5 S |
| 3,216,079 | 11/1965 | Keyworth | 24/269 U X |
| 3,334,805 | 8/1967 | Halbach | 24/30.5 S UX |
| 3,535,746 | 10/1970 | Thomas | 24/30.5 T |
| 3,548,906 | 12/1970 | Murphy | 24/30.5 T UX |
| 3,600,763 | 8/1971 | Weick | 24/137 R |

FOREIGN PATENTS OR APPLICATIONS

| | | | |
|---|---|---|---|
| 571,439 | 3/1959 | Canada | 24/30.5 S |
| 580,190 | 6/1958 | Italy | 24/30.5 S |
| 684,164 | 3/1930 | France | 24/30.5 T |

*Primary Examiner*—Donald A. Griffin

[57] ABSTRACT

This device consist primarily of a plastic or metal body having a shank portion which is integral with a pair of leg portions which will be used to seal the opening ends of plastic bags which hold products, such as various food stuffs and bread.

1 Claim, 2 Drawing Figures

CLOSURE DEVICE

This invention relates to fastening devices, and more particularly to a closure device.

It is therefore the principal object of this invention to provide a closure device which may be stamped out of plastic, or metal and will be used to seal the open ends of plastic bag and the like which hold food products.

Another object of this invention is to provide a closure device which will be easy to apply to a bag and will effectively seal the bag so as to keep the contents fresh therein.

Another object of this invention is to provide a device of the type described, which will last indefinitely.

A further object of this invention is to provide a device of the type described, which will include a shank portion which will define leg portions that are integral thereof, at one end, the leg portions being used to close a bag in a twisting fashion.

Other objects of the invention are to provide a closure device which is simple in design, inexpensive to manufacture, rugged in construction, easy to use and efficient in operation.

These and other objects will be readily evident upon a study of the following specification and the accompanying drawing, wherein.

Figures 1, 2:
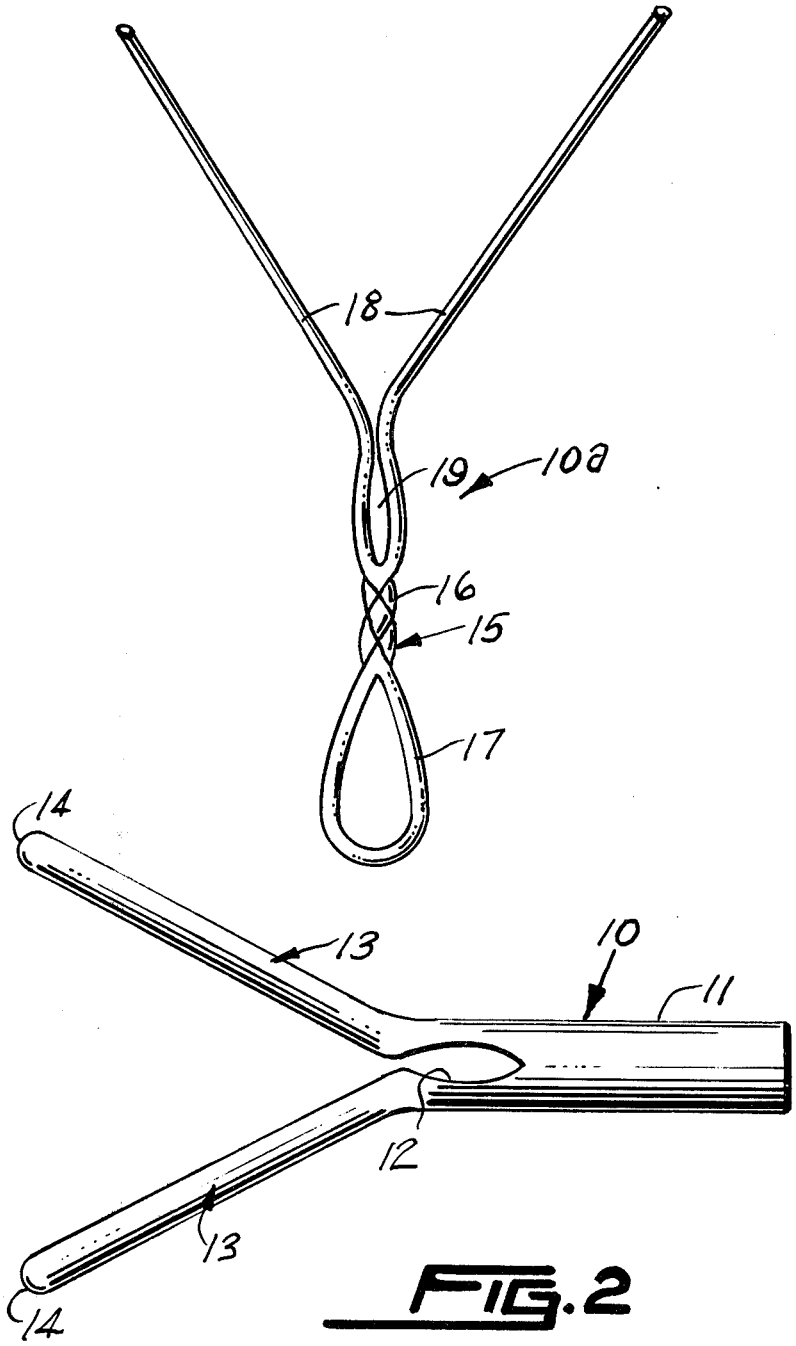
FIG. 1 is a plan view of the present invention.
FIG. 2 is a plan view showing a modified form of the invention.

According to this invention, a closure device 10 is shown to consist of a shank 11 which has defined at one end, an opening 12, the position portion of the shank 11 defining a pair of spaced apart leg portions 13 having rounded ends 14.

In use, the legs 11 are twisted around the open end of a plastic bag so as to tightly seal the bag in order to keep the contents fresh.

Looking now at FIG. 1 of the drawing, a modified form of closure device 10*a* is shown to include a body portion 15 having a twisted area 16 thus forming an eye portion 17. On the opposite side of the twisted area 16, is an open eye portion 19 which defines a pair of spaced apart legs 18 which are twisted on the opening of a bag in a similar manner as heretofore described of the device of FIG. 2.

What I now claim is:

1. A closure device made of wire into an overall one piece Y-shaped configuration, comprising:

a. a shank serving as the stem of the Y configuration, having, a loop of wire creating a central eye at the terminal end of said shank, having also a twisted wire stem portion midway on said shank, and having, in addition, a formed wire portion creating an elongated ovaloid slot at the opposite end of said shank; and b. a pair of diverging legs formed of wires continuing on from said elongated ovaloid slot portion whereby said diverging legs form an included angle therebetween comprising a space that communicates at the juncture of diverging legs with said elongated ovaloid slot.

* * * * *